US007669358B1

(12) United States Patent
Conroy et al.

(10) Patent No.: US 7,669,358 B1
(45) Date of Patent: Mar. 2, 2010

(54) DYNAMIC PROCESS FOR ENHANCING THE WEAR RESISTANCE OF FERROUS ARTICLES

(75) Inventors: Paul J. Conroy, Churchville, MD (US); Charles S. Leveritt, Jarrettsville, MD (US); John D. Demaree, Baltimore, MD (US); James Hirvonen, Havre de Grace, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 500 days.

(21) Appl. No.: 11/723,368

(22) Filed: Mar. 19, 2007

Related U.S. Application Data

(62) Division of application No. 10/985,067, filed on Nov. 5, 2004, now Pat. No. 7,191,558.

(51) Int. Cl.
*F41A 21/22* (2006.01)

(52) U.S. Cl. ..... 42/76.01; 89/14.05; 428/908.8

(58) Field of Classification Search ..... 42/76.01, 42/76.1; 89/14.05, 14.7; 428/908.8; 427/255.394
See application file for complete search history.

(56) References Cited

U.S. PATENT DOCUMENTS 3,611,936 A * 10/1971 Bouisse et al. ..... 102/336
3,942,319 A * 3/1976 Sayles ..... 60/253
5,459,016 A * 10/1995 Debe et al. ..... 430/201
5,487,798 A * 1/1996 Williams ..... 149/22
5,565,646 A * 10/1996 Williams ..... 102/439
5,663,523 A * 9/1997 Williams ..... 102/335
5,674,451 A * 10/1997 Nimitz et al. ..... 422/34
5,780,768 A * 7/1998 Knowlton et al. ..... 149/36
5,810,947 A 9/1998 Wu et al.
5,847,315 A * 12/1998 Katzakian et al. ..... 149/19.91
5,868,424 A * 2/1999 Hamilton et al. ..... 280/741
5,887,558 A 3/1999 Kampichler et al.
6,235,132 B1 * 5/2001 Knowlton et al. ..... 149/36
6,425,966 B1 * 7/2002 Highsmith et al. ..... 149/19.1
6,511,710 B2 * 1/2003 Warnecke ..... 427/449
2002/0104588 A1 8/2002 Oglesby

OTHER PUBLICATIONS

Fernandez Guillermet et al, "Thermodynamic Analysis of the Fe-N System Using the Compound-Energy Model with Predictions of the Vibrational Entropy", Z. Metallkd. 85 (1994) 3, pp. 154-163.

* cited by examiner

*Primary Examiner*—Bret Hayes
(74) *Attorney, Agent, or Firm*—William V. Adams

(57) ABSTRACT

A dynamic process for increasing the wear life of ferrous articles subjected to a high-temperature environment created by combustion of a propellant or fuel comprises selecting the propellant or fuel so that its combustion products include relatively large amounts of nitrogen, which nitrogen forms a protective nitride layer on the surface of the ferrous article. Disclosed is a specific embodiment of the invention for prolonging the wear life of gun barrels.

20 Claims, 2 Drawing Sheets

DYNAMIC PROCESS FOR ENHANCING THE WEAR RESISTANCE OF FERROUS ARTICLES

This application is a Division of and claims priority to prior application Ser. No. 10/985,067 filed Nov. 5, 2004, which is now U.S. Pat. No. 7,191,558.

GOVERNMENT INTEREST

The invention described herein may be manufactured, used, and licensed by or for the United States Government.

FIELD OF THE INVENTION

This invention relates generally to methods for enhancing the resistance of ferrous articles to thermochemical erosion. More specifically, the invention relates to a process which may be implemented in the course of normal operation of an article, which process forms a specific, protective iron nitride coating on the article, which coating protects a surface of the article from degradation in by high-temperature, high-pressure atmospheres.

BACKGROUND OF THE INVENTION

Gun barrels, turbine components, internal combustion engine components, aerospace components, chemical reactors, machine tools, drilling equipment, bearings and the like are often comprised of iron, steel or other ferrous alloys. In use, such articles are frequently exposed to various combinations of high-temperature, high-pressure and corrosive ambient environments. These conditions can cause thermochemical erosion of the substrate materials leading to pitting, cratering, cracking and failure.

The prior art has recognized such problems and has attempted to prevent or minimize the erosion of ferrous materials by the use of various coatings comprised of high hardness materials. For example, U.S. Patent Application Serial No. 2002/0104588 discloses a process for extending the life of mechanical centrifuge screens by forming a layer of high-hardness iron nitride on the screen and subsequently electroplating a layer of chromium onto the nitride layer. The nitride layers of the '588 application are high-hardness layers including at least 33 atomic percent nitrogen. Likewise, U.S. Pat. Nos. 5,887,558 and 5,810,947 show coatings of high-hardness iron nitride used in connection with internal combustion engines and machine tools respectively. As will be explained in detail hereinbelow, such prior art methods have been found to be unsuitable for, and in some instances actually derogatory to, enhancing the thermochemical stability of steel and the like under high-temperature, high-pressure reactive conditions.

The present invention may be utilized to enhance the thermochemical stability of a variety of articles. For the purposes of this present discussion, the invention will be described primarily with regard to gun barrels; however, it is to be understood that the invention may be used with equal advantage in connection with any other articles which are exposed to conditions which include one or more of high-temperature, high-pressure and corrosive environments. These articles include, by way of illustration and not limitation, internal combustion engine components, turbine components, aerospace assemblies, chemical reactors, machine tools, drilling equipment, bearings and the like.

Referring now to FIGS. 1A-1C, there is shown a cross-sectional view of a portion of a gun barrel 10 of the prior art showing various stages in a process leading to its thermochemical erosion. The gun barrel 10 of FIGS. 1A-1C is typical of, and representative of, barrels associated with relatively large artillery pieces as well as small arms. The gun barrel 10 is comprised of a body of steel alloy, and a portion of this body of steel alloy is shown in these figures at reference numeral 12. It is to be understood that in some instances gun barrels are fabricated as composite members having a steel liner which defines the gun bore, and this liner is encased in the body of another material such as a body of metal or a body of a reinforced polymer.

Referring now to FIG. 1A, it will be seen that the barrel 10 includes a coating of chromium 14 deposited on the surface of its bore. This chromium layer 14 is of high-hardness and increases the wear resistance of the barrel 10. It is to be understood that in some instances, the barrel may have a layer of a different refractory material thereatop, or may not have any refractory material at all. The present invention may be used in any of these types of gun barrels. As is shown in FIG. 1A, the layer of chromium 14 includes a number of cracks 16*a*, 16*b* defined therein. These cracks pass through the layer of chromium 14 and expose portions of the surface of the underlying steel alloy 12. Also, it will be noted that a portion of the layer of chromium 14 is flaked away creating a large open area 16*c* which exposes the underlying body of steel 12. Cracking and flaking can occur as a result of stresses which arise when the chromium is deposited, and further cracking and flaking can occur during the use of the gun. Similar cracking and flaking can occur with other refractory layers used for this purpose.

In use, the gun barrel 10 is exposed to a high-temperature, high-pressure corrosive atmosphere created by the propellant gases generated when the gun is fired. These gases include large amounts of CO and $CO_2$ therein together with volatile acids, sulfur-containing compounds, and the like. These reactive gases can be in the form of ions, radicals or neutral species. The cracks 16*a*, 16*b* and void 16*c* will permit these reactive gases to contact the underlying body of steel 12 so as to cause a chemical reaction to occur between the components of the propellant gas and the steel. For example, it has been demonstrated that CO can react with the steel of gun barrels, under firing conditions, to cause carburization of the steel. As is shown in FIG. 1B, this reaction has created carburized regions 18*a*-18*c* in the steel 12.

Carburization can adversely change the properties of the steel. For example, a typical gun steel has a melting point of approximately 1723° K; however, if the steel is carburized, its melting point drops to 1423° K. The lowering of the melting point makes carburized portions of the barrel prone to pitting and other erosion as a result of the continuing use of the barrel.

As is shown in FIG. 1C, the carburized regions of FIG. 1B have eroded away producing pitted regions 20*a*, 20*b*, 20*c* in the steel 12. As will be seen, these pitted regions 20 have undercut portions of the chrome layer 14 which can lead to further cracking and flaking of that layer. In addition, the relatively rough surface of the pitted regions 20 is highly prone to further carburization and erosion. Similar reactions can also occur in engines, turbines and the like under high-temperature and/or high-pressure conditions.

Clearly there is a need for a method for stabilizing iron, steel and other ferrous alloys against thermochemical corrosion which can occur under severe use conditions. Such methods should be simple to implement and should not interfere with the function of the item. As will be explained in greater detail hereinbelow, the present invention provides a method for enhancing the resistance of ferrous materials to thermochemical erosion. The method of the present invention is unique insofar as it is a dynamic method; that is to say, it is a method which can be implemented while the article is in service. The method of the present invention does not require any pretreatment of the article, nor does it require any modification of the function or operation of the article. These and other advantages of the present invention will be described in detail hereinbelow.

BRIEF DESCRIPTION OF THE INVENTION

There is disclosed herein a method for enhancing the wear life of a ferrous article which is exposed to a high-temperature atmosphere created by the combustion of a fuel. The method comprises providing a high-nitrogen content fuel which is capable of generating, upon combustion, a combustion gas which includes at least 20% by mole fraction of nitrogen. The method includes the further step of combusting the fuel so as to generate the combustion gas and exposing the article to the combustion gas so that the nitrogen in the combustion gas reacts with the ferrous article so as to form an iron-nitride coating upon at least a portion of the article. In particular embodiments, the iron-nitride coating is characterized in that the atomic percentage of nitrogen therein is greater than 0 but no more than 20%. In specific embodiments, the percentage of nitrogen in the coating is in the range of –10-15 atomic percent. In some embodiments, high-nitrogen content fuel is capable of generating a combustion gas which includes at least 30% by mole fraction of nitrogen therein.

In one group of embodiments, the ferrous article comprises the bore of a gun, and the fuel comprises a high-nitrogen propellant. In such embodiments, when the gun is fired, the resultant propellant gas nitrides the steel of the gun barrel so as to minimize thermochemical erosion.

DESCRIPTION OF THE INVENTION

Figure 1A:
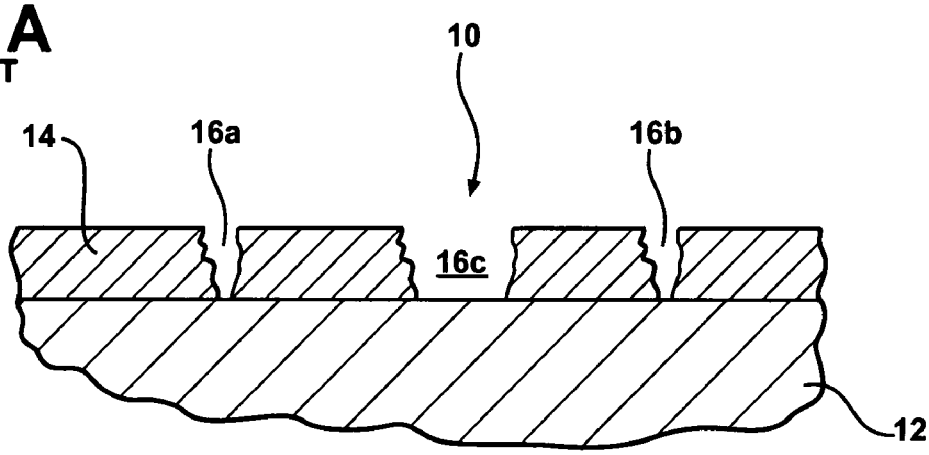
FIG - 1A PRIOR ART
FIGS. 1A-1C are cross sections of a portion of a gun barrel showing the steps which occur during the thermochemical erosion of the barrel.

The present invention recognizes that articles such as gun barrels, internal combustion engine components, turbines, aerospace systems, chemical reactors, machine tools, drilling equipment, bearings, and other devices and components which ate exposed to high-temperature conditions created by combustion products of fuels, propellants and the like, can be protected by a dynamic nitriding process wherein the combustion products create a reactive atmosphere which forms a protective nitride on the article.

The present invention further recognizes that certain low-nitrogen, iron-nitride materials are particularly effective for protecting ferrous articles from thermochemical erosion; and, while the present invention may be practiced with various nitrides, the use of these low-nitrogen nitrides is particularly advantageous. These iron-nitrides, in contrast to iron-nitrides generally employed as protective coatings, are characterized by having a low content of nitrogen. In general, the preferred nitride layers of the present invention include no more than 20 atomic percent of nitrogen.

In contrast, prior art nitride protective layers such as those discussed in the '588 application cited above are optimized for high hardness and include significantly larger amounts of nitrogen therein. Typically, such layers include at least 33 atomic percent nitrogen. The prior art high-hardness nitride layers have very good wear resistance under low-temperature and low-pressure conditions; however, the present invention recognizes that these materials have relatively low melting points and do not function very well under conditions of high-temperature and pressure as are encountered in gun barrels, internal combustion engines, turbines and the like. In fact, the presence of such prior art layers can, in some instances, be detrimental to the service life of particular items.

In contrast to prior art high-nitrogen nitrides, the low-nitrogen nitrides of the present invention have a melting point which is in excess of 1600° K. In particular, specifically preferred materials of the present invention have a melting point of at least 1680° K, and one specific group of nitrides melts at 1683° K. Nitride materials having such melting points are disclosed in the publication: "*Thermodynamic Analysis of the Fe—N System Using the Compound Energy Model With Predictions of the Vibrational Entropy*", Guillermet et al., Metallkunde (1994), pp. 154-163.

The nitrides of the present invention generally include nitrogen in an amount greater than 0 and up to 20 atomic percent. In one particular group of materials, the atomic percent of nitrogen is in the range of 5-20%. In specific instances, the nitrogen is present in an amount of at least 10 atomic percent; and in another specific group of embodiments, the atomic percentage of nitrogen is in the range of 10-15%.

The present invention recognizes that the formation of the protective nitride layer may be accomplished by a dynamic process which occurs during the use of the article which is to be protected. The advantage of employing a dynamic process of this type is that the generation of the protective layer is ongoing, and does not require removing the article from service or implementing any additional steps. The process will be described with particular reference to gun barrels, although it is to be understood that the invention is not limited to this use.

In the use of a gun barrel, a propellant charge is ignited in the breech of the gun so as to cause combustion of the propellant material. This combustion generates a heated, high-pressure volume of propellant gas which expands in the gun barrel to drive a projectile therethrough. As discussed above, the propellant gas typically includes reactive species such as CO which can cause thermochemical erosion of the gun barrel. The present invention recognizes that the composition of the propellant gas may be controlled so as to provide beneficial chemical species therein, in a highly reactive form. Specifically, the propellant gas of the present invention includes at least 20 mole percent of a nitrogen species therein, and in some embodiments the propellant gas includes approximately 30 mole percent of a nitrogen species. This nitrogen species may comprise monatomic or diatomic nitrogen gas as well as reactive nitrogen species such as $NH_3$, hydrazines, reactive oxides of nitrogen, and organic compounds such as amines. The nitrogen species may be neutral, ionized, or in the form of radicals.

The nitrogen species in the propellant gas react with iron to form a coating of an iron nitride on exposed steel surfaces of the gun barrel. This nitride is, as described above, preferably a low-nitrogen nitride.

The ratios of the various components of the propellant gas may be controlled so as to optimize the process of the present invention. In one group of embodiments, the mole fraction ratio of CO to $CO_2$ should be as low as possible, but not less than 3.0. Also, the mole fraction ratio of nitrogen to CO should be as high as possible. In general, the ratio should be at least 0.65, and preferably above 0.8.

Figure 1B:
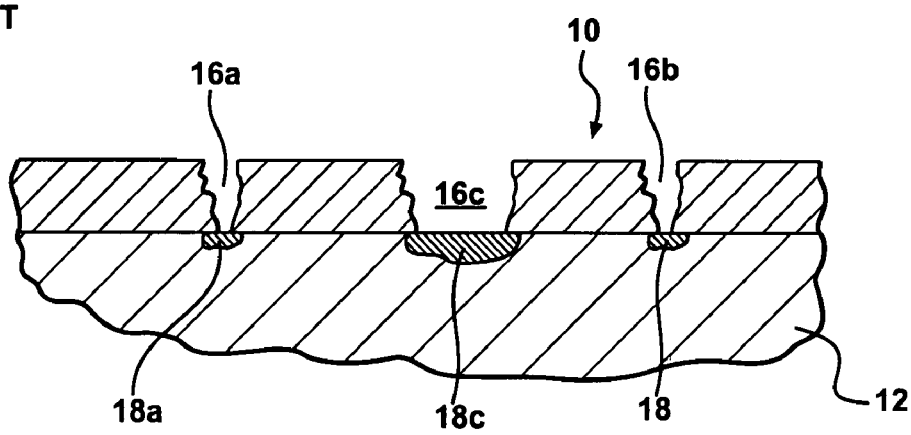
FIG - 1B PRIOR ART
Figure 1C:
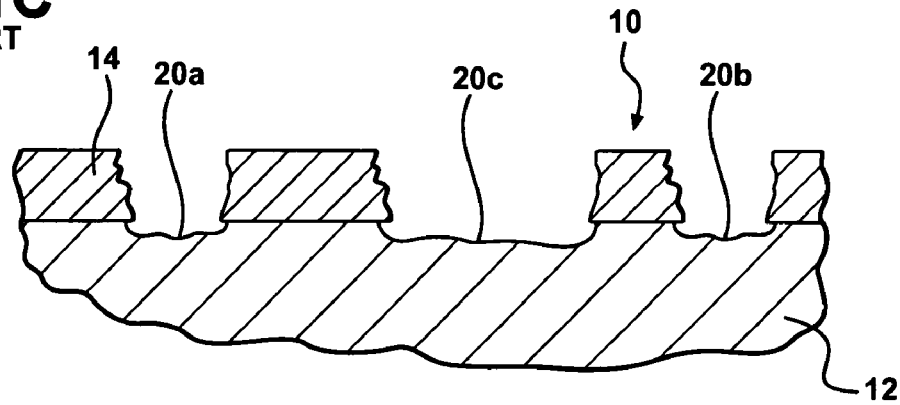
FIG - 1C PRIOR ART

Referring now to FIGS. 2A-2D, there is shown a series of steps in the dynamic nitriding process of the present invention as carried out on a gun barrel 10 which is generally similar to the gun barrel described with reference to FIGS. 1A-1C. As discussed above, the gun barrel 10 is comprised of a steel body 12 defining the gun bore, and in this embodiment, a layer of chromium 14 is plated atop the steel 12. As discussed above, the layer of chromium 14 may be replaced by a layer of a different refractive material, or it may be eliminated completely. The present invention is useful in connection with all such embodiments.

Figure 2A:
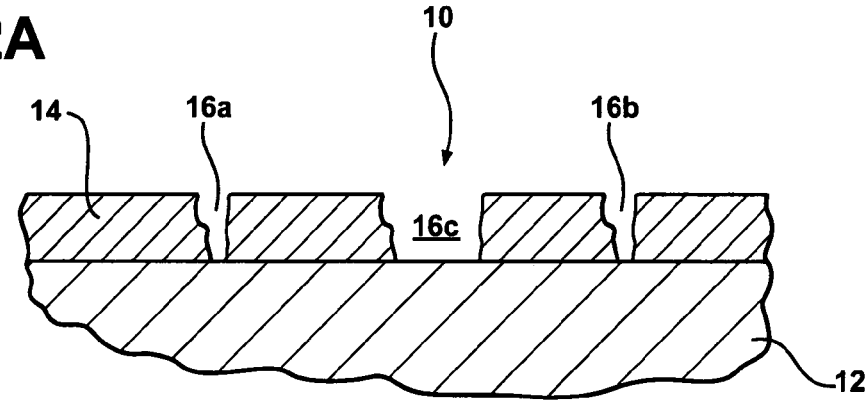
FIGS. 2A-2D show a cross-sectional view of a portion of a gun barrel illustrating the steps resulting in the formation of a protective nitride layer thereupon in accord with the principles of the present invention.

FIG. 2A shows a portion of a gun barrel 10 prior to the implementation of the dynamic nitriding process of the present invention. As is shown in FIG. 2A, the layer of chromium 14 includes cracks 16*a*, 16*b* as well as a void 16*c* defined by a flaked-away portion of the chromium layer 14.

Figure 2B:
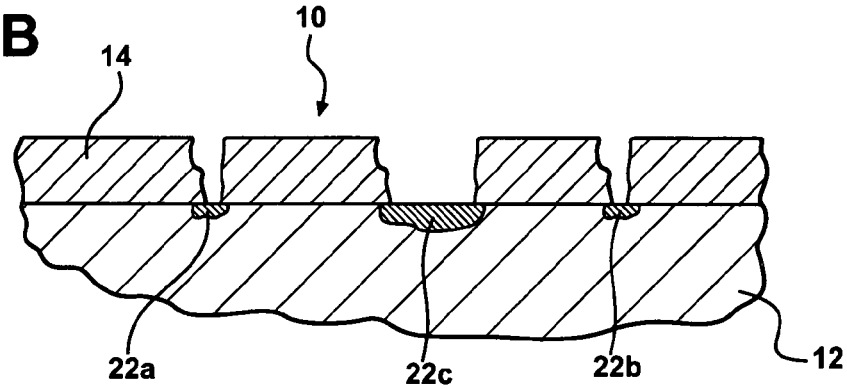

Referring now to FIG. 2B, there is shown a portion of the gun barrel 10 of FIG. 2A after the dynamic nitriding process of the present invention. Specifically, in FIG. 2B, the propellant charge has been ignited, and the exposed portions of the body of steel 12 have been contacted by the nitrogen containing propellant gas. As will be seen, this has created nitrided regions 22*a*, 22*b*, 22*c* in the steel 12. It will be appreciated that while the interface between the nitrided regions 22 and the steel 12 is shown as being a sharp interface, the nitriding process is based upon diffusion of nitrogen into the steel, which diffusion is driven by the heat and pressure of the propellant gas. As a consequence, the nitride layer 22 may have a graded composition such that higher nitrogen contents are found at the upper surface, and nitrogen content may decrease throughout the thickness of the layer. It will be understood by those of skill in the art that during subsequent firings of the gun, the nitrogen content and/or thickness of the layer may increase up to some point where diffusion limits are reached. As described above, the nitrided layer 22*a* protects the underlying steel 12 from carburization and thermochemical erosion.

Figure 2C:
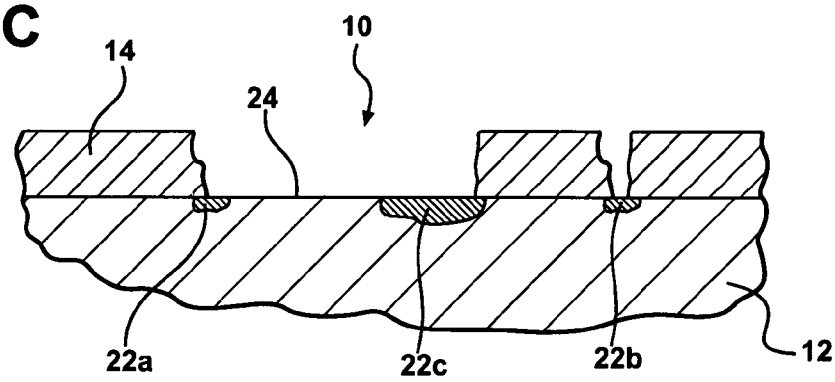
Figure 2D:
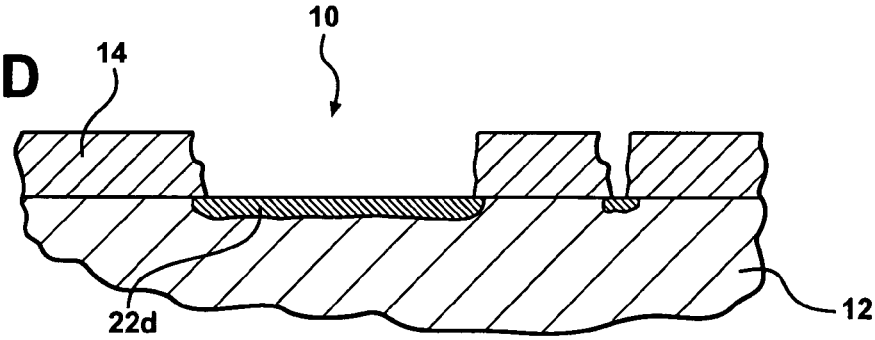

A particular advantage of the present invention is that it is a dynamic process which is continuously repeated throughout the use of the gun barrel or other item. This allows for ongoing treatment. Referring now to FIG. 2C, there is shown the gun barrel of FIG. 2B having nitrided regions 22*a*, 22*b* and 22*c* formed therein. As will be seen in FIG. 2C, a portion of the chromium layer 14 has flaked away, as may occur during the use of the gun barrel. This has exposed a fresh surface 24 of the body of steel 12. As is shown in FIG. 2D, subsequent firing of the gun will cause this freshly exposed surface 24 to nitride thereby forming an extended protective layer 22*d*.

As will be seen, in the context of a gun barrel the present invention employs a propellant composition which will generate a propellant gas which is capable of nitriding the surface of the barrel. This propellant product gas will generally include at least 20% nitrogen therein, and in some embodiments will include at least 30% nitrogen therein. The nitrogen content of the propellant may be readily controlled by one of skill in the art by controlling the chemical composition of the propellant. For example, addition of azide compounds such as sodium azide to the base propellant will result in the generation of large volumes of nitrogen. Azide compounds have the additional advantage of being explosive and will comprise advantageous additives to propellant compositions. Other sources of nitrogen will comprise high-nitrogen explosives such as PETN and the like. Diazo compounds are also good sources of nitrogen and may be likewise employed. Hydrazines, including substituted hydrazines, are also highly reactive species which can release large amounts of nitrogen, and such materials may be employed in the practice of the present invention. In some instances, propellant compositions will have to be adjusted to incorporate additional oxidizers, depending upon the particular source of nitrogen employed. Also, as described above, the mole fraction ratio of CO to $CO_2$ in the propellant gas should be low, but at least 3.0; and the mole fraction ratio of nitrogen to CO should be high, and at least 0.65, and preferably at least 0.8. These ratios may be controlled by controlling the composition of the propellant as described above. Specifically, nitrogen generating materials and/or oxidizers may be added to a propellant or other fuel to provide a combustion product of a desired composition.

The use of the present invention is not restricted to gun barrels. Other ferrous articles which are exposed to a reactive working atmosphere may be protected in accord with the present invention by controlling the chemical composition of that atmosphere so as to cause it to form a protective nitride coating on the articles. For example, fuel burned in an internal combustion engine may be formulated to include a—source of nitrogen and/or an oxidizer therein as was described above with reference to propellants; and this nitrogen can operate to form a protective nitride coating on valves, cylinders, pistons, piston rings and the like during the use of the engine. The oxidizer and the source of nitrogen in the fuel may comprise a compound which is directly blended into the fuel, or it may comprise a species which is introduced into the fuel stream and/or the combustion chamber separately from the fuel. The oxidizer and the source of nitrogen may be a solid, a liquid or a gas. Likewise, the present invention may be employed to protect surfaces of turbines and chemical reactors as well as bearing surfaces, bearings and other ferrous articles which are exposed to combustion products in a high-temperature and/or high-pressure working atmospheres.

The present invention may be employed on a continuous basis wherein a system or apparatus employs the high-nitrogen propellant or other fuel of the present invention on a continuous basis. The invention may also be practiced on an intermittent basis. For example, in the case of a gun, only a portion of the propellant products discharged in the gun may comprise high-nitrogen propellants. Likewise, in the case of internal combustion engines, turbines and the like, the high-nitrogen fuel of the present invention may only be employed during part of the time that the system is in service.

In view of the teaching presented herein, it will be apparent to one of skill in the art that various embodiments of the invention may be implemented. All of such modifications and variations are within the scope of the present invention. The foregoing drawings, discussion and description are illustrative of specific embodiments of the invention, but are not meant to be limitations upon the practice thereof. It is the following claims, including all equivalents, which define the scope of the invention.

The invention claimed is:

1. A method for enhancing the wear life of a ferrous article which is exposed to a high-temperature atmosphere created by the combustion of a fuel, said method comprising:

providing a nitrogen content fuel, said fuel generating, upon combustion, a combustion product gas which includes at least 20% by mole fraction nitrogen, wherein the mole fraction ratio of CO to $CO_2$ in the combustion product gas is greater than 3.0, and the mole fraction ratio of nitrogen to CO in the combustion product gas is at least 0.65;

combusting said fuel so as to generate said combustion gas; and exposing said ferrous article to said combustion product gas, whereby the nitrogen in said combustion product gas reacts with said ferrous article so as to form an iron-nitride coating upon at least a portion thereof.

2. The method of claim 1, wherein said iron-nitride is characterized in that the atomic percentage of nitrogen therein is greater than 0, but no more than 20%.

3. The method of claim 1, wherein the atomic percent of nitrogen in said iron-nitride is in the range of 5-20%.

4. The method of claim 1, wherein the atomic percent of nitrogen in said iron-nitride is at least 10%.

5. The method of claim 1, wherein the atomic percent of nitrogen in said iron-nitride is in the range of 10-15%.

6. The method of claim 1, wherein the melting point of said iron-nitride is at least 1600° K.

7. The method of claim 1, wherein the melting point of said iron-nitride is at least 1680° K.

8. The method of claim 1, wherein said fuel, upon combustion, generates a combustion product gas which includes at least 30% by mole fraction of nitrogen therein.

9. The method of claim 1, wherein said article comprises a component of an internal combustion engine.

10. The method of claim 9, wherein said nitrogen content fuel is employed only during a part of the time that the internal combustion engine is in operation.

11. The method of claim 1, wherein said article comprises a component of a turbine exposed to combustion products.

12. The method of claim 11, wherein said nitrogen content fuel is employed only during a part of the time that the turbine is in operation.

13. The method of claim 1, wherein the mole fraction ratio of nitrogen to CO in said combustion gas is at least 0.80.

14. The method of claim 1, wherein said nitrogen content fuel is formulated to include a source of nitrogen and an oxidizer therein.

15. The method of claim 14, wherein said source of nitrogen comprises a compound which is directly blended into the fuel.

16. The method of claim 15 wherein the oxidizer and the source of nitrogen are solids.

17. The method of claim 15 wherein the oxidizer and the source of nitrogen are liquids.

18. The method of claim 16 wherein the oxidizer and the source of nitrogen are gases.

19. A method for enhancing the wear life of a ferrous article which is exposed to a high-temperature atmosphere created by the combustion of a fuel, said method comprising:

a fuel stream;

introducing into said fuel stream an oxidizer and a source of nitrogen so that said fuel stream generates, upon combustion, a combustion product gas which includes at least 20% by mole fraction nitrogen, wherein the mole fraction ratio of CO to $CO_2$ in the combustion product gas is greater than 3.0, and the mole fraction ratio of nitrogen to CO in the combustion product gas is at least 0.65;

combusting said fuel so as to generate said combustion gas; and exposing said ferrous article to said combustion product gas, whereby the nitrogen in said combustion product gas reacts with said ferrous article so as to form an iron-nitride coating upon at least a portion thereof.

20. A method for enhancing the wear life of a ferrous article which is exposed to a high-temperature atmosphere created by the combustion of a fuel, said method comprising:

introducing a fuel stream into a combustion chamber;

introducing an oxidizer and a source of nitrogen into said combustion chamber separately from said fuel stream so that said fuel stream generates, upon combustion, a combustion product gas which includes at least 20% by mole fraction nitrogen, wherein the mole fraction ratio of CO to $CO_2$ in the combustion product gas is greater than 3.0, and the mole fraction ratio of nitrogen to CO in the combustion product gas is at least 0.65;

combusting said fuel so as to generate said combustion gas; and exposing said ferrous article to said combustion product gas, whereby the nitrogen in said combustion product gas reacts with said ferrous article so as to form an iron-nitride coating upon at least a portion thereof.

* * * * *